US012297724B1

(12) United States Patent
Latimer et al.

(10) Patent No.: US 12,297,724 B1
(45) Date of Patent: May 13, 2025

(54) SELF-CORRECTING FLOW IN SUBSURFACE WELLS

(71) Applicant: Fervo Energy Company, Houston, TX (US)

(72) Inventors: Timothy Latimer, Houston, TX (US); Jack Norbeck, Golden, CO (US)

(73) Assignee: Fervo Energy Company, Houston, TX (US)

( * ) Notice: Subject to any disclaimer, the term of this patent is extended or adjusted under 35 U.S.C. 154(b) by 0 days.

(21) Appl. No.: 18/234,242

(22) Filed: Aug. 15, 2023

Related U.S. Application Data

(60) Provisional application No. 63/398,091, filed on Aug. 15, 2022.

(51) Int. Cl.
*E21B 43/16* (2006.01)
*E21B 43/12* (2006.01)
*E21B 43/26* (2006.01)

(52) U.S. Cl.
CPC ..... *E21B 43/16* (2013.01); *E21B 43/126* (2013.01); *E21B 43/26* (2013.01)

(58) Field of Classification Search
CPC ..... E21B 43/16; E21B 43/126; E21B 43/25; E21B 43/26
See application file for complete search history.

(56) References Cited

U.S. PATENT DOCUMENTS 4,200,152 A * 4/1980 Foster ..... E21B 43/283 166/308.1
2007/0107901 A1* 5/2007 Maguire ..... F24T 10/20 166/308.1
2016/0102528 A1* 4/2016 Wise ..... E21B 21/062 166/336
2020/0217181 A1* 7/2020 Norbeck ..... F24T 10/20

* cited by examiner

*Primary Examiner* — Silvana C Runyan
(74) *Attorney, Agent, or Firm* — Schwegman Lundberg & Woessner, P.A.

(57) ABSTRACT

Systems and techniques may include enhancing production of a natural resource from a reservoir in the earth.

By pumping and circulating a material through a reservoir, where the material interacts with proppant or formation material in fracture zones, the interaction reduces permeability in an overproductive fracture zone and redirects flow to an underproductive fracture zone. Through this self-correcting feedback mechanism, flow redistributes more uniformly across multiple fracture zones over time, resulting in more even permeability distribution and improved reservoir performance. The systems and techniques enable passive treatment using chemical solutions that create self-correcting permeability changes, leading to more controlled and efficient resource recovery from subsurface reservoirs.

16 Claims, 3 Drawing Sheets

SELF-CORRECTING FLOW IN SUBSURFACE WELLS

CLAIM OF PRIORITY

This international application claims the benefit of priority to U.S. Provisional Patent Application Ser. No. 63/398,091 filed Aug. 15, 2022, titled "A METHOD FOR CONTROLLING NEAR-WELLBORE FLOW IN SUBSURFACE WELLS," the contents of which is hereby incorporated by reference herein in its entirety.

BACKGROUND

Generally, near-wellbore effects can influence and in certain situation provide a strong influence on the ability for fluid to flow between a subsurface formation and a wellbore during drilling, workover, completions, and production.

These detrimental effects can arise, for example, during drilling, lost circulations materials can be pumped along with drilling mud to mitigate fluid flow into the reservoir causing lost circulation. During wellbore completion and hydraulic stimulation in oil and gas wells, the perforation geometry and fluid pumping schedule are designed to distribute flow across multiple perforation clusters to promote even fracture propagation. During stimulation of geothermal reservoirs, chemical diverters can be used to temporarily encourage zonal isolation in an open-hole wellbore. During production, methods to control near-wellbore flow depend on the type of wellbore completion. In geothermal energy applications, for example, slotted liners are often installed in open-hole completions to allow for unimpeded flow. In oil and gas applications, it can be common to case and cement the well with a solid steel liner, therefore requiring perforations to regain access to the formation. Near-wellbore radial pressure gradients can be large and can cause performance issues such as sanding; therefore, sometimes hydraulic fractures are created with the intended purpose of causing bilinear flow to reduce near-wellbore pressure gradients and flow velocities. Scab liners, essentially small-diameter tubes in-between two packers, can be installed to allow flow to bypass around breaches in casing or poorly performing perforations. Chemical diverters can be used to temporarily plug perforations to divert flow past old perforations during refracturing operations.

These prior techniques have many failings, including limited applicability based upon well type and problem, other adverse or unexpected results, cost, potential for lost production time, inoperability, limited success rates (both qualitative and quantitative). Thus, for these and other reasons they have not meet the long standing need for enhanced and greater efficiency in the recovery of natural resources from the earth.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various examples discussed in the present document.

DETAILED DESCRIPTION

Figure 1:
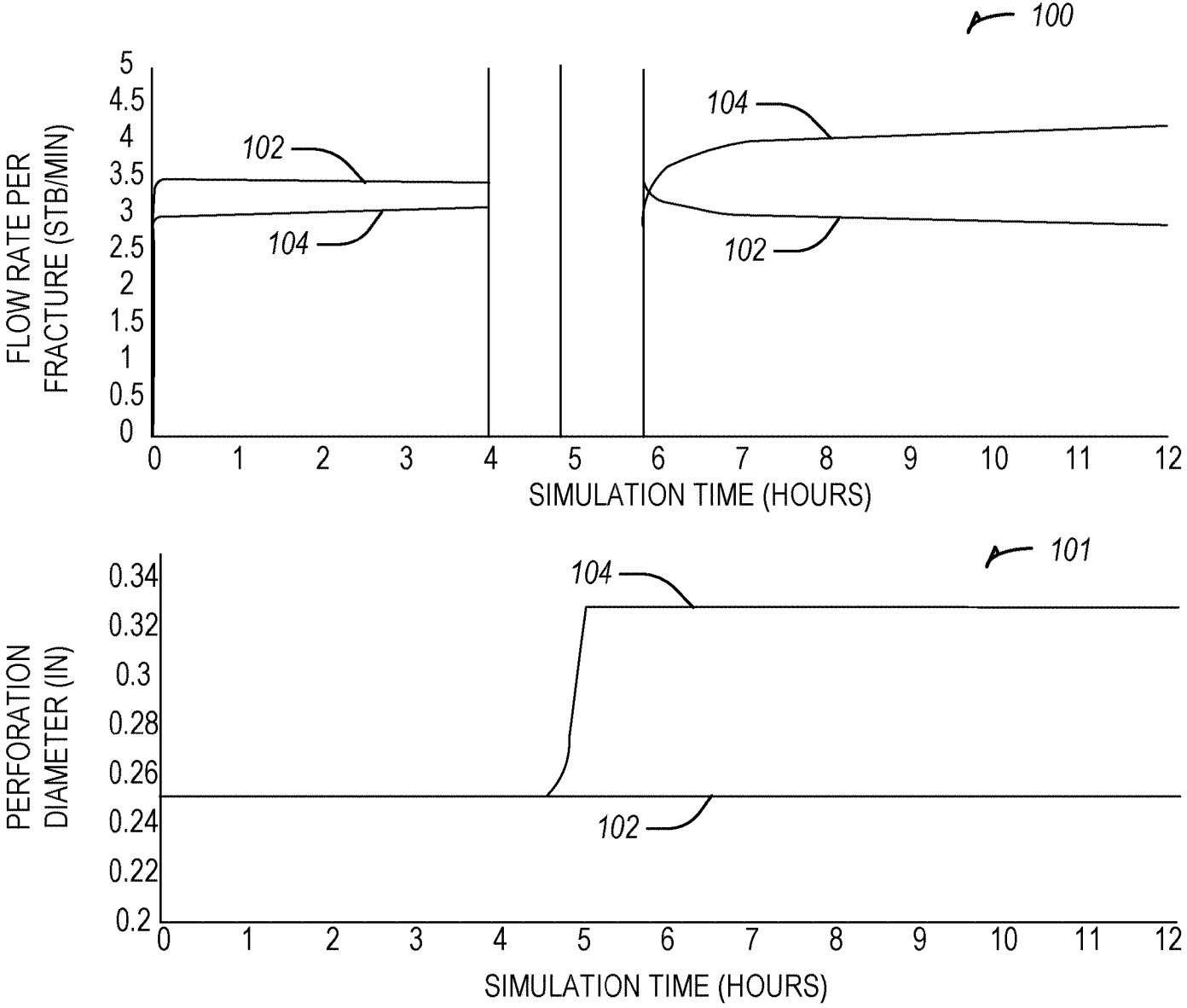
FIG. 1 illustrates a graph showing a flow rate distribution and a graph showing a change in perforation diameter in two fracture zones before and after a perforation erosion treatment in accordance with examples described herein.

Typically, in the production of natural resources from formations within the earth a well or borehole is drilled into the earth to the location where the natural resource is believed to be located. These natural resources may be a heat source for geothermal energy, a hydrocarbon reservoir, containing natural gas, crude oil and combinations of these; the natural resource may be fresh water; or it may be some other natural resource that is located within the ground.

These resource-containing formations may be a few hundred feet, a few thousand feet, or tens of thousands of feet below the surface of the earth, including under the floor of a body of water, e.g., below the sea floor. In addition to being at various depths within the earth, these formations may cover areas of differing sizes, shapes and volumes.

Unfortunately, and generally, when a well is drilled into these formations the natural resources rarely flow into and out of the formation, and into the well at rates, durations and amounts that are economically viable. This problem occurs for several reasons, some of which are well understood, others of which were not as well understood, some of which may not yet be known, and several of which were incorrect prior to the systems and techniques described herein. These problems can relate to the viscosity of the natural resource, the porosity of the formation, the geology of the formation, the formation pressures, and the perforations that place the production tubing in the well in fluid communication with the formation, to name a few.

Typically, and by way of general illustration, in drilling a well an initial borehole is made into the earth, e.g., the surface of land or seabed, and then subsequent and smaller diameter boreholes are drilled to extend the overall depth of the borehole. In this manner as the overall borehole gets deeper its diameter becomes smaller; resulting in what can be envisioned as a telescoping assembly of holes with the largest diameter hole being at the top of the borehole closest to the surface of the earth.

Typically, when completing a well, it is necessary to perform a perforation operation. In general, when a well has been drilled and casing, e.g., a metal pipe, is run to the prescribed depth, the casing is typically cemented in place by pumping cement down and into the annular space between the casing and the earth. (It is understood that many different down hole casing, open hole, and completion approaches may be used.) The casing, among other things, prevents the hole from collapsing and fluids from flowing between permeable zones in the annulus. Thus, this casing forms a structural support for the well and a barrier to the earth.

While important for the structural integrity of the well, the casing and cement present a problem when they are in the production zone. Thus, in addition to holding back the earth, they also prevent the resources or fluid from flowing into and out of the well and from being recovered. Additionally, the formation itself may have been damaged by the drilling process, e.g., by the pressure from the drilling mud, and this damaged area of the formation may form an additional barrier to the flow of resources. Similarly, in most situations where casing is not needed in the production area, e.g., open hole, the formation itself is generally tight, and more typically can be very tight, and thus, will not permit the flow of resources into and out of the well.

To address, in part, this problem of the flow of resources e.g., geothermal, hydrocarbons, etc. into the well being blocked by the casing, cement and the formation itself, openings, e.g., perforations, are made in the well in the area of the pay zone. Generally, a perforation is a small, about ¼" to about 1" or 2" in diameter hole that extends through the casing, cement and damaged formation and goes into the formation. This hole creates a passage for the resource to flow from the formation into the well. In a typical well, a large number of these holes are made through the casing and into the formation in the pay zone.

As used herein, unless specified otherwise, the term "earth" should be given its broadest possible meaning, and includes, the ground, all natural materials, such as rocks, and artificial materials, such as concrete, that are or may be found in the ground, including without limitation rock layer formations, such as, granite, basalt, sandstone, dolomite, sand, salt, limestone, rhyolite, quartzite and shale rock.

As used herein, unless specified otherwise, the term "borehole" should be given it broadest possible meaning and includes any opening that is created in a material, a work piece, a surface, the earth, a structure (e.g., building, protected military installation, nuclear plant, offshore platform, or ship), or in a structure in the ground, (e.g., foundation, roadway, airstrip, cave or subterranean structure) that is substantially longer than it is wide, such as a well, a well bore, a well hole, a micro hole, slimhole, a perforation and other terms commonly used or known in the arts to define these types of narrow long passages. Wells may further include exploratory, production, abandoned, reentered, reworked, and injection wells. Although boreholes are generally oriented substantially vertically, they may also be oriented on an angle from vertical, to and including horizontal. Thus, using a vertical line, based upon a level as a reference point, a borehole can have orientations ranging from 0° i.e., vertical, to 90°, i.e., horizontal and greater than 90° e.g., such as a heel and toe and combinations of these such as for example "U" and "Y" shapes. Boreholes may further have segments or sections that have different orientations, they may have straight sections and arcuate sections and combinations thereof, and for example may be of the shapes commonly found when directional drilling is employed. Thus, as used herein unless expressly provided otherwise, the "bottom" of a borehole, the "bottom surface" of the borehole and similar terms refer to the end of the borehole, i.e., that portion of the borehole furthest along the path of the borehole from the borehole's opening, the surface of the earth, or the borehole's beginning. The terms "side" and "wall" of a borehole should to be given their broadest possible meaning and include the longitudinal surfaces of the borehole, whether or not casing or a liner is present, as such, these terms may include the sides of an open borehole or the sides of the casing that has been positioned within a borehole. Boreholes may be made up of a single passage, multiple passages, connected passages and combinations thereof, in a situation where multiple boreholes are connected or interconnected each borehole may have a borehole bottom. Boreholes may be formed in the sea floor, under bodies of water, on land, in ice formations, or in other locations and settings.

Boreholes are generally formed and advanced by using mechanical drilling equipment having a rotating drilling tool, e.g., a bit. For example and in general, when creating a borehole in the earth, a drilling bit is extending to and into the earth and rotated to create a hole in the earth. In general, to perform the drilling operation the bit must be forced against the material to be removed with a sufficient force to exceed the shear strength, compressive strength or combinations thereof, of that material. Thus, in conventional drilling activity mechanical forces exceeding these strengths of the rock or earth must be applied. The material that is cut from the earth is generally known as cuttings, e.g., waste, which may be chips of rock, dust, rock fibers and other types of materials and structures that may be created by the bit's interactions with the earth. These cuttings are typically removed from the borehole by the use of fluids, which fluids can be liquids, foams or gases, or other materials know to the art.

As used herein, unless specified otherwise, the term "advancing" a borehole should be given its broadest possible meaning and includes increasing the length of the borehole. Thus, by advancing a borehole, provided the orientation is not horizontal, e.g., less than 90° the depth of the borehole may also be increased. The true vertical depth ("TVD") of a borehole is the distance from the top or surface of the borehole to the depth at which the bottom of the borehole is located, measured along a straight vertical line. The measured depth ("MD") of a borehole is the distance as measured along the actual path of the borehole from the top or surface to the bottom. As used herein unless specified otherwise the term depth of a borehole may refer to MD. In general, a point of reference may be used for the top of the borehole, such as the rotary table, drill floor, well head or initial opening or surface of the structure in which the borehole is placed.

As used herein, unless specified otherwise, the terms "workover," "completion" and "workover and completion" and similar such terms should be given their broadest possible meanings and may include activities that place at or near the completion of drilling a well, activities that take place at or the near the commencement of production from the well, activities that take place on the well when the well is producing or operating well, activities that take place to reopen or reenter an abandoned or plugged well or branch of a well, and may also include for example, perforating, cementing, acidizing, fracturing, pressure testing, the removal of well debris, removal of plugs, insertion or replacement of production tubing, forming windows in casing to drill or complete lateral or branch wellbores, cutting and milling operations in general, insertion of screens, stimulating, cleaning, testing, analyzing and other such activities. These terms may further include applying heat, directed energy, optionally in the form of a high power laser beam to heat, melt, soften, activate, vaporize, disengage, desiccate and combinations and variations of these, materials in a well, or other structure, to remove, assist in their removal, cleanout, condition and combinations and variation of these, such materials.

Generally, the term "about" and the symbol "~" as used herein unless stated otherwise is meant to encompass a variance or range of +10%, the experimental or instrument error associated with obtaining the stated value, and optionally the larger of these.

As used herein, unless specified otherwise, the terms "formation," "reservoir," "pay zone," and similar terms, are to be given their broadest possible meanings and may include all locations, areas, and geological features within the earth that contain, may contain, or are believed to contain, the desired resource, e.g., geothermal heat, hydrocarbons, etc.

As used herein, unless specified otherwise, the terms "field," "oil field" "geothermal field" and similar terms, are to be given their broadest possible meanings, and may include any area of land, sea floor, or water that is loosely or directly associated with a formation, and more particularly with a resource containing formation, thus, a field may have one or more exploratory and producing wells associated with it, a field may have one or more governmental body or private resource leases associated with it, and one or more field(s) may be directly associated with a resource containing formation.

As used herein, unless specified otherwise, the terms "conventional gas", "conventional oil", "conventional", "conventional production" and similar such terms are to be given their broadest possible meaning and include hydrocarbons, e.g., gas and oil, that are trapped in structures in the earth. Generally, in these conventional formations the hydrocarbons have migrated in permeable, or semi-permeable formations to a trap, or area where they are accumulated. Typically, in conventional formations a non-porous layer is above, or encompassing the area of accumulated hydrocarbons, in essence trapping the hydrocarbon accumulation. Conventional reservoirs have been historically the sources of the vast majority of hydrocarbons produced. As used herein, unless specified otherwise, the terms "unconventional gas", "unconventional oil", "unconventional", "unconventional production" and similar such terms are to be given their broadest possible meaning and includes hydrocarbons that are held in impermeable rock, and which have not migrated to traps or areas of accumulation.

As used herein, unless specified otherwise, the terms "hydrocarbon exploration and production", "exploration and production activities", "E&P", and "E&P activities", and similar such terms are to be given their broadest possible meaning, and include surveying, geological analysis, well planning, reservoir planning, reservoir management, drilling a well, workover and completion activities, hydrocarbon production, flowing of hydrocarbons from a well, collection of hydrocarbons, secondary and tertiary recovery from a well, the management of flowing hydrocarbons from a well, and any other upstream activities.

As used herein, unless specified otherwise, the terms "poroelastic", "poroelasticity", "poroelastic stresses", "poroelastic forces" and similar such terms should be given their broadest possible meanings and may include the forces, stresses and effects that are based upon the interaction between fluid flow and solid deformation within a porous medium. Typically, in evaluating poroelastic effects Darcy's law, which describes the relation between fluid motion and pressure within a porous medium, is coupled with the structural displacement of the porous matrix.

As used herein, unless specified otherwise, the terms "geothermal", "geothermal well", "geothermal resource", "geothermal energy" and similar such terms, should be given their broadest possible meaning and including wells, systems and operations that recover or utilize the heat energy that is contained within the earth. Such systems and operations may include enhanced geothermal well, engineered geothermal wells, binary cycle power plants, dry steam power plants, flash steam power plants, open looped systems, and closed loop systems.

As used herein, unless specified otherwise, the terms "near-wellbore", "near", "near-wellbore flow" and similar such terms, should be given their broadest possible meaning and may include distances, the areas defined by those distances, and both, extending radially outward from the borehole including: from the borehole wall to about 150 feet; from about 0.1" (inches) to about 25 feet; from about 0.5 feet to about 40 feet; from the borehole wall to about 10 feet; from about 0.25 feet to about 15 feet; from about 0.25 feet to about 75 feet; where proppant is found; where hydraulic fractures have been induced; and distances within these ranges, as well as larger and smaller distances.

The ability of, or ease with which, the natural resource can flow out of the formation and into the well or production tubing (into and out of, for example, in the case of engineered geothermal wells, and some advanced recovery methods for hydrocarbon wells) can generally be understood as the fluid communication between the well and the formation. As this fluid communication is increased several enhancements or benefits may be obtained: the volume or rate of flow (e.g., gallons per minute) can increase; the distance within the formation out from the well where the natural resources may flow into the well can be increase (e.g., the volume and area of the formation that can be drained by a single well is increased, and it may thus take less total wells to recover the resources from an entire field); the time period when the well is producing resources can be lengthened; the flow rate can be maintained at a higher rate for a longer period of time; and combinations of these and other efficiencies and benefits.

Fluid communication between the formation and the well can be increased by the use of hydraulic stimulation techniques. The first uses of hydraulic stimulation date back to the late 1940s and early 1950s. In general, hydraulic treatments involve forcing fluids down the well and into the formation, where the fluids enter the formation and crack, e.g., force the layers of rock to break apart or fracture. These fractures create channels or flow paths that may have cross sections of a few micron's, to a few millimeters, to several millimeters in size, and potentially larger. The fractures may also extend out from the well in all directions for a few feet, several feet and tens of feet or further. It should be remembered that the longitudinal axis of the well in the reservoir may not be vertical: it may be on an angle (either slopping up or down) or it may be horizontal. The section of the well located within the reservoir, i.e., the section of the formation containing the natural resources, can be called the pay zone.

Although hydraulic stimulation has been used in geothermal wells, the use of proppants has generally not been used, and its use has been discredited by those in the art.

Generally, in prior geothermal wells, even those that have been hydraulically stimulated, the performance and efficiency of the well, and geothermal power plant, has been less than desirable and suboptimal. This suboptimal performance has hindered the adoption of geothermal energy, making its replace of hydrocarbon energy sources difficult. This suboptimal performance has reduced the ability of geothermal energy, which is a clean, carbon free energy source, from being widely adopted and replacing carbon emitting, e.g., coal, oil, natural gas, power generation sources.

This low efficiency or lack of performance in geothermal wells is also seen in the inefficiency of the recovery of oil and natural gasses from hydrocarbon wells, i.e., wells that are production hydrocarbons.

The systems and techniques described herein may be used to control near-wellbore fluid flow in a subsurface reservoir for applications in oil and gas, mining, and geothermal energy activities.

There has been a long-standing and unfulfilled need for enhanced methods to recover resources from the earth. In particular, there has been a long standing and unfulfilled need to control near-wellbore fluid flow in subsurface reservoirs to enhance, manage and permit the recovery of natural resources, e.g., oil, gas, minerals, ores and geothermal fluids, from reservoirs in the earth. The systems and techniques described herein, among other things, solve these needs by providing the systems, materials, articles of manufacture, devices and processes taught, disclosed and claimed herein. Accordingly, in an example, near-wellbore proppant is flushed from an over productive perforated zone to inhibit flow.

In an example, a chemical solution is pumped to target an over productive perforated zone to react with and dissolve a specified amount of proppant material to inhibit flow.

In an example, a chemical solution is pumped to target an over productive perforated zone to react with and dissolve the formation material to increase flow.

In an example, an underperforming perforated zone is targeted and subjected to perforation erosion techniques to improve flow.

In an example, an overperforming perforated zone is targeted and subjected to a chemical treatment to precipitate material onto the casing material to inhibit flow.

In an example, a chemical solution is pumped into multiple perforated zones at once in a passive treatment to cause self-correcting feedbacks in permeability changes that result in each zone taking an even distribution of flow.

In general, the systems and techniques described herein control near-wellbore fluid flow in a subsurface reservoir. In particular, systems and techniques described herein relate to using chemical and mechanical effects in oil and gas, mining, and geothermal energy activities to manage, control, mitigate, enhance and utilized near-wellbore fluid flow.

In an example, the systems and techniques described herein relate to methods of operating wells to improve and enhance the recovery of resources for the earth, based at least in part, on using chemical and mechanical near wellbore fluid flow effects.

The systems and techniques described herein have application to oil and gas activities, such as waterflooding, steam flooding, steam assisted gravity drainage, and enhanced oil recovery. The systems and techniques described herein have application to geothermal energy activities, where thermal energy is extracted from subsurface formations by circulating a working fluid, such as water or carbon dioxide, through the formation and recovering the heated fluid.

The commercial viability of a geothermal power system depends on the long-term thermal sustainability of the reservoir. Thermal energy recovery efficiency is defined as the amount of heat recovered over the lifetime of a project relative to the initial amount of heat in place. Thermal breakthrough is defined as the time at which the temperature of the produced fluid has dropped by a threshold amount, which is controlled by the rate at which the thermal front propagates through the reservoir. The systems and techniques described herein relate to methods to design geothermal reservoir systems to control heat recovery efficiency and thermal breakthrough to improve the system's thermal sustainability.

It should be understood that while this Specification focuses on the recovery of geothermal resources and hydrocarbon resources from beneath the surface of the earth, its applications are not so limited. Thus, the present well systems, methods of drilling and completing wells, and well configurations may find applicability in the recovery of minerals and ores, and other resources within the ground.

In general, examples of the present well configurations have one, two, three, four or more wells. These wells can be vertical, vertical with horizontal section, vertical with sloped section, branched configurations, comb configurations, combinations and variations of these, and other configurations known to or later developed by the art and combinations and variations of these. These wells can have a TVD of from about 1,000 feet (ft) to about 20,000 ft, from about 2,000 ft to about 10,000 ft, about 2,000 ft to about 15,000 ft, and all values within these ranges, as well as larger and smaller values. These wells can have MD from about 1,000 feet (ft) to about 25,000 ft, from about 2,000 ft to about 10,000 ft, about 2,000 ft to about 15,000 ft, and all values within these ranges, as well as larger and smaller values.

Flow between a wellbore and a formation can be influenced by a range of factors that can depend on the type of well bore completion and the properties of the formation. Examples of the systems and techniques described herein find application in one, many and across numerous types, and in particular across the types that are found in a particular field. In this manner, in an example, a single type of the present solutions can find applicability in an entire field.

Typically, in a conventional, vertical oil or gas well in a permeable formation, near-wellbore effects can include pressure drop in the wellbore, pressure drop across the perforations, skin effects, and pressure drop due to radial or spherical flow in porous media, to name a few. For a horizontal well completed with multistage hydraulic fracturing, near-wellbore effects can include pressure drop in the wellbore, pressure drop across the perforations, tortuosity of the fractures, stress-dependent conductivity of proppant, and pressure drop due to bilinear flow in the fracture and formation, to name a few. For geothermal wells completed open-hole with slotted liner, near-wellbore effects can include pressure drop along a rough wellbore, additional pressure drop in the wellbore due to the slotted liner, stress-dependent permeability of natural fractures intersecting the well, and dual-permeability effects caused by the interaction between fractures and the surrounding porous media, to name a few. The systems, methods and materials of the present examples address, enhance and manage these and other near-wellbore flow conditions.

Generally, an example changes, e.g., increases or decreases the fluid flow to the near-wellbore by changing the properties of the proppant, the proppant-pack, and both. Chemicals, heat (hot fluids, either heated in situ, or prior to or while pumping down hole), pressure, flow rate, and combinations and variations of these are utilized. These techniques change the fluid flow properties of the proppant, and in particular the proppant pack though chemical, physical and both changes to the proppant material. Thus, for example the proppant can be dissolved, eroded, etched, for example, to enhance near-wellbore flow characteristics of the well. The changes to the proppant and proppant pack may include for example: increased void space in the proppant pack; decreased void space in the proppant pack; proppant material mobilization; and proppant material migration.

Packers, plugs, and other mechanical, chemical, or chemical-mechanical ways to isolate the wellbore, and thus the formation adjacent to that section of the wellbore, can be used to perform particular and predetermined treatments on the limited or isolated section of the wellbore and its associate formation. In this manner different treatments can be performed on different sections of the wellbore, with each treatment designed to meet the specific flow issue for that section of the wellbore.

Generally, the systems and techniques described herein are used to increase or decrease near wellbore permeability through changing, e.g., dissolution, weakening, precipitation, of the formation; and optionally the formation adjacent to the proppant and proppant pack. The walls of the fractured zone can be comprised of a wide variety of mineralogical compounds. Chemical solutions are chosen such that they react chemically with the fracture wall material.

Temperature, flow rate and other physical effects, e.g., particles, abrasives, gels, can be combined with or used with the chemicals to enhance the effects of the various examples.

These treatments and methods and systems can result in a predetermined change in the permeability of the fracture zone, a predetermined change in the fluid conductivity from the formation into the wellbore, e.g., flow into the production tubing; a predetermined change in the conductivity of the proppant pack; a predetermined change in the properties of the formation, other changes in flow characterizes of the near-wellbore formation, and combinations and variations. These predetermined changes can be an increase in permeability, a decrease in permeability, and increase in flow, a decrease in flow, and increase in conductivity, a decrease in conductivity, and combinations and variations of these.

In an example, a method and material are used to increase or decrease the permeability of a proppant-packed fracture through chemical dissolution or precipitation of the proppant. Proppant material can be comprised of a wide variety of naturally occurring or artificially created chemical compounds, can vary in particle size distribution, and can vary in shape. Chemical solutions are chosen such that they react chemically with the proppant material. A single proppant-packed fracture zone is isolated with packers, and the chemical solution treatment is applied via coiled tubing. The chemical reaction can cause chemical dissolution of the proppant grains or precipitation of minerals onto the proppant grains, resulting in i) additional void space, ii) decreased void space, or iii) proppant material mobilization, any of which may result in either increased or decreased permeability of the fracture zone.

In an example, a method and material are used to increase or decrease the permeability of a proppant-packed fracture through chemical dissolution or precipitation of the fracture material. The walls of the fractured zone can be comprised of a wide variety of mineralogical compounds. Chemical solutions are chosen such that they react chemically with the fracture wall material. A single proppant-packed fracture or natural fracture is isolated with packers, and the chemical solution treatment is applied via coiled tubing. The chemical reaction can cause chemical dissolution of fracture walls or precipitation of minerals onto the fracture walls, resulting in i) additional void space, ii) decreased void space, or iii) proppant material mobilization, any of which may result in either increased or decreased permeability of the fracture zone.

In an example, a method and material are used to increase flow through a perforated completion by modifying the properties of the perforation. An underproductive zone is isolated with packers, and the treatment is applied via coiled tubing. An abrasive material is injected such that flow through the perforations erodes the perforations, providing increased flow capacity.

In an example, a method and material are used to decrease flow through a perforated completion by modifying the properties of the perforation. An over-productive zone is isolated with packers, and the treatment is applied via coiled tubing. A chemical solution is injected such that flow through the perforations causes precipitation of material to selectively occur on the casing cement, restricting the flow capacity.

In an example, a method and material are used to cause self-correcting feedback in permeability changes across multiple flow pathways that results in more evenly distributed flow rates. The systems and techniques described herein relate to a system involving flow between two or more adjacent wells connected hydraulically through multiple fracture zones. A chemical solution that reacts either with proppant material or with the fracture wall material is injected during relatively long-term fluid circulation. The chemical solution is chosen such that it has the effect of reducing the permeability of the fracture zone as it reacts with the proppant or fracture wall material. Flow pathways that initially have relatively high permeability, therefore taking more flow, may be exposed to the chemical reaction and may decrease permeability over time. Flow may redistribute over time in a self-correcting manner, resulting in a more even distribution of flow and more controlled reservoir behavior.

In an example, a method and material are used to cause self-correcting feedback in permeability changes across multiple flow pathways that results in more evenly distributed flow rates. This systems and techniques described herein relate to a system involving flow between two or more adjacent wells connected hydraulically through multiple fracture zones. A thermally-activated chemical solution that reacts either with proppant material or with the fracture wall material is injected during relatively long-term fluid circulation. The chemical solution is chosen such that it has the effect of increasing the permeability of the fracture zone as it reacts with the proppant or fracture wall material. Flow pathways that initially have relatively low permeability, therefore taking less flow, tend to have higher temperature. The thermally-activated chemical reaction may occur in the low-permeability zones, increasing their permeability over time. Flow may redistribute over time in a self-correcting manner, resulting in a more even distribution of flow and more controlled reservoir behavior.

FIG. 1 illustrates is a graph 100 showing a flow rate distribution and a graph 101 showing a change in perforation diameter in two fracture zones, including a first fracture 102 and a second fracture 104 before and after a perforation erosion treatment in accordance with examples described herein. FIG. 1 shows results of numerical simulation showing relative flow rates and in two fractures 102 and 104 with different permeability in graph 100 and the evolution of perforation diameter in graph 101 over time. Initially, a first fracture 102 (high permeability fracture) takes more flow than a second fracture 104 (low permeability fracture). After four hours of injection, perforation erosion at the second fracture 104 perforation cluster is targeted and achieved by pumping a sand-laden slurry at high rates. After the perforation erosion treatment is finished (at around 5.7 hours), the flow rate in the second fracture 104 is increased significantly.

Figure 2:
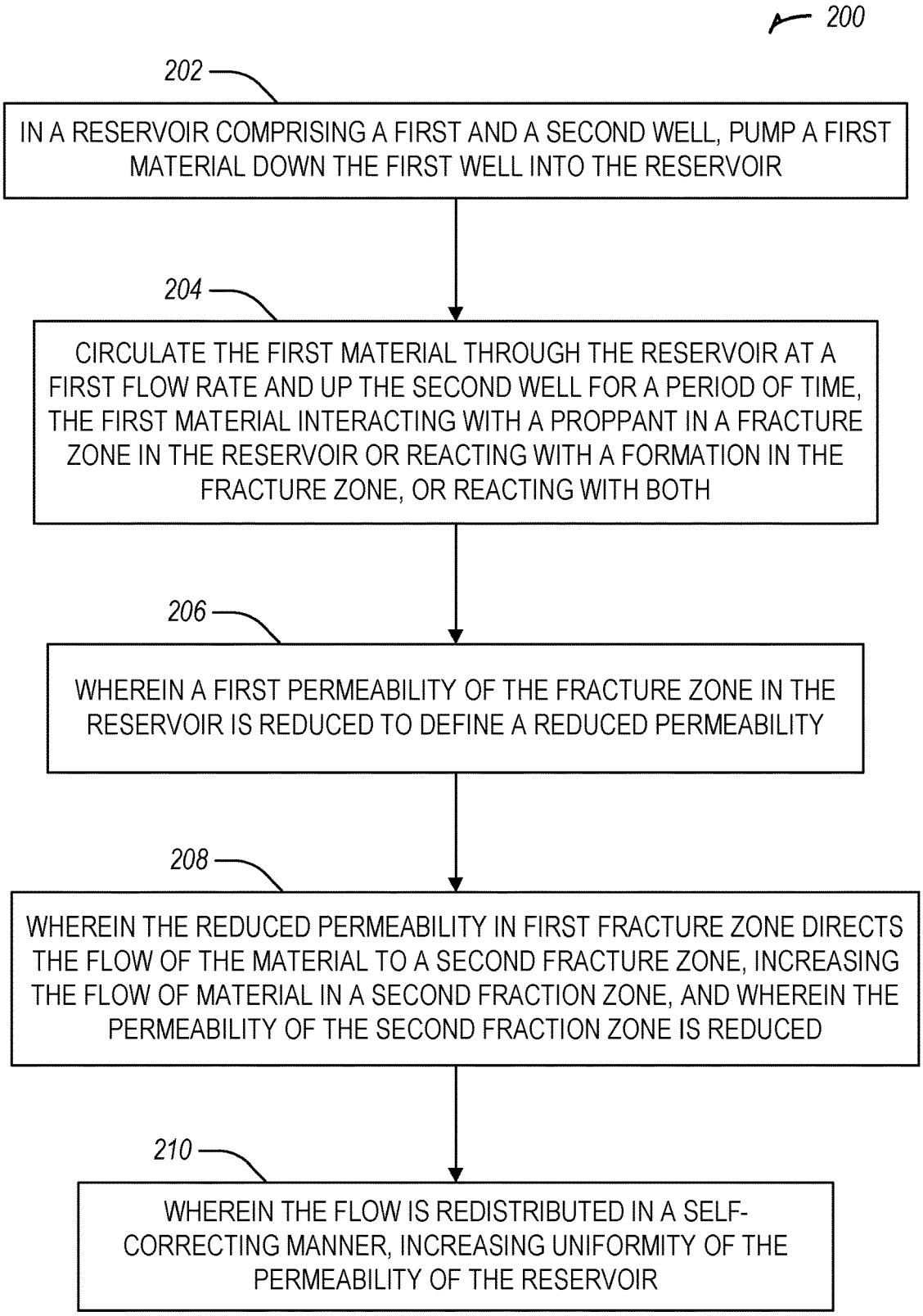
FIG. 2 an example technique for enhancing production of a natural resource from a reservoir in the earth in accordance with examples described herein.

FIG. 2 an example technique 200 for enhancing production of a natural resource from a reservoir in the earth in accordance with examples described herein. The natural resource may comprise a hydrocarbon, a crude oil, or a geothermal resource.

The technique 200 includes an operation 202 to in a reservoir comprising a first and a second well, pump a first material down the first well into the reservoir.

The technique 200 includes an operation 204 to circulate the first material through the reservoir at a first flow rate and up the second well for a period of time, the first material interacting with a proppant in a fracture zone in the reservoir or reacting with a formation in the fracture zone, or reacting with both. The first material may comprise a chemical and the interaction may include a chemical reaction. The first material may comprise a colloid. The first material may comprise a nanocomposite.

The technique 200 includes an operation 206 to wherein a first permeability of the fracture zone in the reservoir is reduced to define a reduced permeability.

The technique 200 includes an operation 208 to wherein the reduced permeability in first fracture zone directs the flow of the material to a second fracture zone, increasing the flow of material in a second fraction zone, and wherein the permeability of the second fraction zone is reduced.

The technique 200 includes an operation 210 to wherein the flow is redistributed in a self-correcting manner, increasing uniformity of the permeability of the reservoir. The increase in the permeability of the reservoir may result in a fracture zone having 80%, 85%, more than 85%, 90%, 95%, or the like a same permeability along a length of the wellbore. The length of the wellbore may include 20 feet to 200 feet, 50 feet to 500 feet, greater than 100 feet, greater than 500 feet, or the like.

Figure 3:
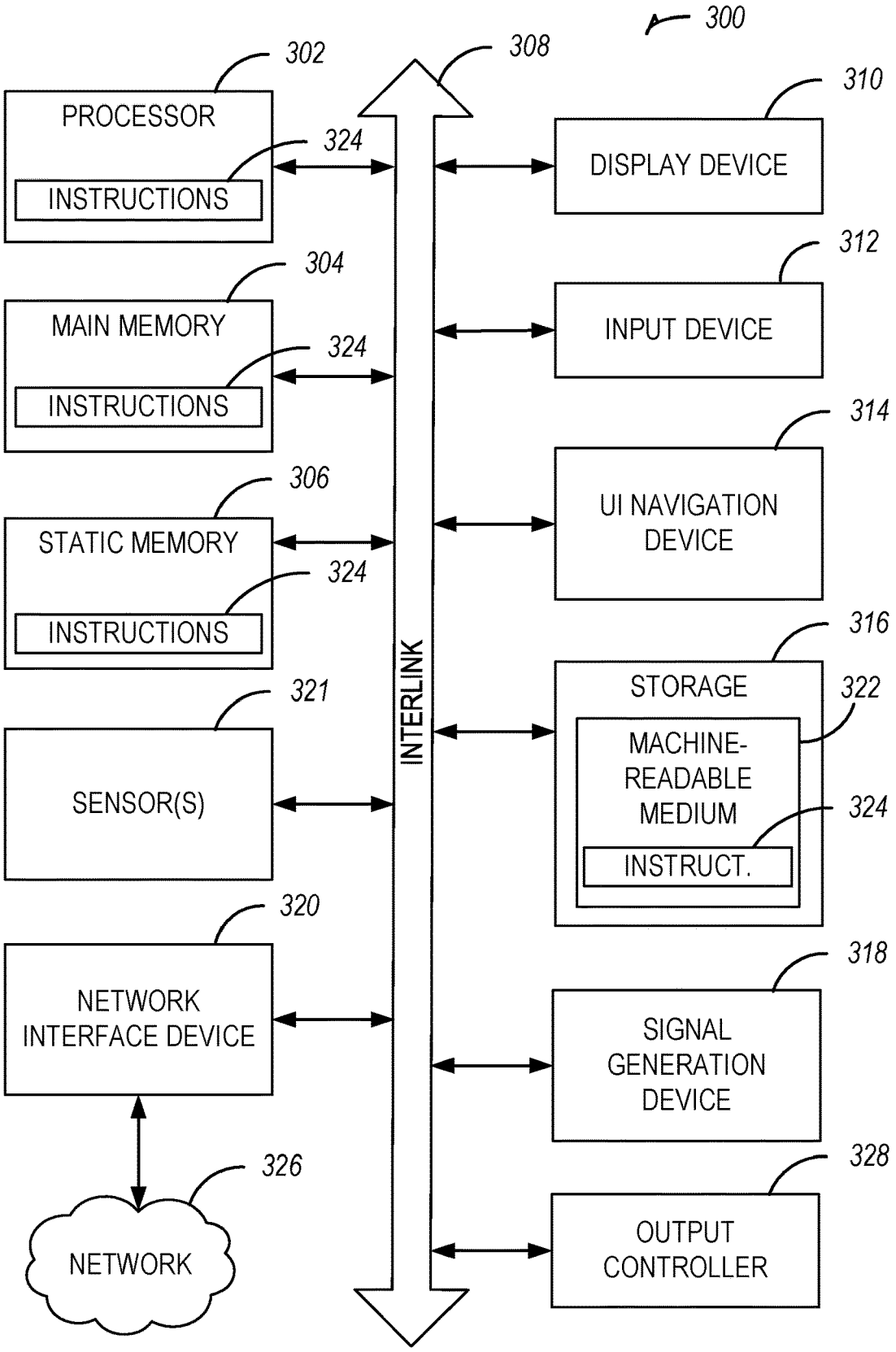
FIG. 3 illustrates generally an example of a block diagram of a machine upon which any one or more of the techniques discussed herein may perform in accordance with some examples.

FIG. 3 illustrates generally an example of a block diagram of a machine 300 upon which any one or more of the techniques (e.g., methodologies) discussed herein may perform in accordance with some examples. In alternative embodiments, the machine 300 may operate as a standalone device or may be connected (e.g., networked) to other machines. In a networked deployment, the machine 300 may operate in the capacity of a server machine, a client machine, or both in server-client network environments. In an example, the machine 300 may act as a peer machine in peer-to-peer (P2P) (or other distributed) network environment. The machine 300 may be a personal computer (PC), a tablet PC, a set-top box (STB), a personal digital assistant (PDA), a mobile telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

Examples, as described herein, may include, or may operate on, logic or a number of components, modules, or mechanisms. Modules are tangible entities (e.g., hardware) capable of performing specified operations when operating. A module includes hardware. In an example, the hardware may be specifically configured to carry out a specific operation (e.g., hardwired). In an example, the hardware may include configurable execution units (e.g., transistors, circuits, etc.) and a computer readable medium containing instructions, where the instructions configure the execution units to carry out a specific operation when in operation. The configuring may occur under the direction of the executions units or a loading mechanism. Accordingly, the execution units are communicatively coupled to the computer readable medium when the device is operating. In this example, the execution units may be a member of more than one module. For example, under operation, the execution units may be configured by a first set of instructions to implement a first module at one point in time and reconfigured by a second set of instructions to implement a second module.

Machine (e.g., computer system) 300 may include a hardware processor 302 (e.g., a central processing unit (CPU), a graphics processing unit (GPU), a hardware processor core, or any combination thereof), a main memory 304 and a static memory 306, some or all of which may communicate with each other via an interlink (e.g., bus) 308. The machine 300 may further include a display unit 310, an alphanumeric input device 312 (e.g., a keyboard), and a user interface (UI) navigation device 314 (e.g., a mouse). In an example, the display unit 310, alphanumeric input device 312 and UI navigation device 314 may be a touch screen display. The machine 300 may additionally include a storage device (e.g., drive unit) 316, a signal generation device 318 (e.g., a speaker), a network interface device 320, and one or more sensors 321, such as a global positioning system (GPS) sensor, compass, accelerometer, or other sensor. The machine 300 may include an output controller 328, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

The storage device 316 may include a machine readable medium 322 that is non-transitory on which is stored one or more sets of data structures or instructions 324 (e.g., software) embodying or utilized by any one or more of the techniques or functions described herein. The instructions 324 may also reside, completely or at least partially, within the main memory 304, within static memory 306, or within the hardware processor 302 during execution thereof by the machine 300. In an example, one or any combination of the hardware processor 302, the main memory 304, the static memory 306, or the storage device 316 may constitute machine readable media.

While the machine readable medium 322 is illustrated as a single medium, the term "machine readable medium" may include a single medium or multiple media (e.g., a centralized or distributed database, or associated caches and servers) configured to store the one or more instructions 324.

The term "machine readable medium" may include any medium that is capable of storing, encoding, or carrying instructions for execution by the machine 300 and that cause the machine 300 to perform any one or more of the techniques of the present disclosure, or that is capable of storing, encoding or carrying data structures used by or associated with such instructions. Non-limiting machine-readable medium examples may include solid-state memories, and optical and magnetic media. Specific examples of machine-readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 324 may further be transmitted or received over a communications network 326 using a transmission medium via the network interface device 320 utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), and wireless data networks (e.g., Institute of Electrical and Electronics Engineers (IEEE) 802.11 family of standards known as Wi-Fi®, IEEE 802.16 family of standards known as WiMax®), IEEE 802.15.4 family of standards, peer-to-peer (P2P) networks, among others. In an example, the network interface device 320 may include one or more physical jacks (e.g., Ethernet, coaxial, or phone jacks) or one or more antennas to connect to the communications network 326. In an example, the network interface device 320 may include a plurality of antennas to wirelessly communicate using at least one of single-input multiple-output (SIMO), multiple-input multiple-output (MIMO), or multiple-input single-output (MISO) techniques. The term "transmission medium" shall be taken to include any intangible medium that is capable of storing, encoding or carrying instructions for execution by the machine 300, and includes digital or analog communications signals or other intangible medium to facilitate communication of such software.

The following, non-limiting examples, detail certain aspects of the present subject matter to solve the challenges and provide the benefits discussed herein, among others.

Example 1 is a method of enhancing production of a natural resource from a reservoir in the earth the method comprising: in a reservoir comprising a first and a second well, pumping a first material down the first well into the reservoir; circulating the first material through the reservoir at a first flow rate and up the second well for a period of time, the first material interacting with a proppant in a fracture zone in the reservoir or reacting with a formation in the fracture zone, or reacting with both; wherein a first permeability of the fracture zone in the reservoir is reduced to define a reduced permeability; wherein the reduced permeability in first fracture zone directs the flow of the material to a second fracture zone, increasing the flow of material in a second fraction zone, and wherein the permeability of the second fraction zone is reduced; and wherein the flow is redistributed in a self-correcting manner, increasing uniformity of the permeability of the reservoir.

In Example 2, the subject matter of Example 1 includes, wherein the natural resource comprises a hydrocarbon.

In Example 3, the subject matter of Examples 1-2 includes, wherein the natural resource comprises a crude oil.

In Example 4, the subject matter of Examples 1-3 includes, wherein the natural resource comprises a geothermal resource.

In Example 5, the subject matter of Examples 1-4 includes, wherein the material comprises a chemical and the interaction is a chemical reaction.

In Example 6, the subject matter of Examples 1-5 includes, wherein the material comprises a colloid.

In Example 7, the subject matter of Examples 1-6 includes, wherein the material comprises a nanocomposite.

In Example 8, the subject matter of Examples 1-7 includes, wherein the increase in the permeability of the reservoir results in a fracture zone having about 90% a same permeability along a length of the wellbore that is from about 20 feet to about 200 feet.

In Example 9, the subject matter of Examples 1-8 includes, wherein the increase in the permeability of the reservoir results in a fracture zone having about 95% a same permeability along a length of the wellbore that is from about 20 feet to about 200 feet.

In Example 10, the subject matter of Examples 1-9 includes, wherein the increase in the permeability of the reservoir results in a fracture zone having more than 85% of the permeability being a same permeability along a length of the wellbore that is from about 20 feet to about 200 feet.

In Example 11, the subject matter of Examples 1-10 includes, wherein the increase in the permeability of the reservoir results in a fracture zone having about 90% a same permeability along a length of the wellbore that is from about 50 feet to about 500 feet.

In Example 12, the subject matter of Examples 1-11 includes, wherein the increase in the permeability of the reservoir results in a fracture zone having about 95% a same permeability along a length of the wellbore that is from about 50 feet to about 500 feet.

In Example 13, the subject matter of Examples 1-12 includes, wherein the increase in the permeability of the reservoir results in a fracture zone having more than 85% of the permeability being a same permeability along a length of the wellbore that is from about 50 feet to about 500 feet.

In Example 14, the subject matter of Examples 1-13 includes, wherein the increase in the permeability of the reservoir results in a fracture zone having about 90% a same permeability along a length of the well bore that is greater than 100 feet.

In Example 15, the subject matter of Examples 1-14 includes, wherein the increase in the permeability of the reservoir results in a fracture zone having about 95% a same permeability along a length of the wellbore that is greater than 500 feet.

In Example 16, the subject matter of Examples 1-15 includes, wherein the increase in the permeability of the reservoir results in a fracture zone having more than 85% of the permeability being a same permeability along a length of the wellbore that is from about 20 feet to about 200 feet.

Example 17 is a method of redistributing the permeability of a fracture zone along the length of a well bore, comprising circulating a permeability reducing material through the reservoir, wherein the flow of the material is self-correcting, thereby increasing the uniformity of the permeability in the fracture zone.

Example 18 is an apparatus comprising means to implement of any of Examples 1-17.

Example 19 is a system to implement of any of Examples 1-17. Example 20 is a method to implement of any of Examples 1-17.

The above detailed description includes references to the accompanying drawings, which form a part of the detailed description. The drawings show, by way of illustration, specific examples in which the inventive subject matter can be practiced. Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

The above description is intended to be illustrative, and not restrictive. For example, the above-described examples (or one or more aspects thereof) may be used in combination with each other. Other examples can be used, such as by one of ordinary skill in the art upon reviewing the above description. The Abstract is provided to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed example. Thus, the following claims are hereby incorporated into the Detailed Description as examples, with each claim standing on its own as a separate example, and it is contemplated that such examples can be combined with each other in various combinations or permutations. The scope of the inventive subject matter should be determined with reference to the appended claims, along with the full scope of equivalents to which such claims are entitled.

What is claimed is:

1. A method of enhancing production of a natural resource from a reservoir in earth, the method comprising:

in a reservoir comprising a first well and a second well, pumping a first material down the first well into the reservoir; and circulating the first material through the reservoir at a first flow rate and up the second well for a period of time, the first material interacting with a proppant material and a formation material in a first fracture zone and a second fracture zone in the reservoir;

wherein, in a first circulation of the first material, a first permeability of the first fracture zone in the reservoir is reduced by the first material to define a first reduced permeability in the first fracture zone;

wherein, in a second circulation of the first material, the first reduced permeability in the first fracture zone directs flow of the first material to the second fracture zone, increasing the flow of the first material in the second fracture zone, and wherein a second permeability of the second fracture zone is reduced; and wherein the flow of the first material is redistributed between the first fracture zone and the second fracture zone in a self-correcting manner based on the circulating the first material through the reservoir, increasing uniformity of permeability of the reservoir.

2. The method of claim 1, wherein the natural resource comprises a hydrocarbon.

3. The method of claim 1, wherein the natural resource comprises a crude oil.

4. The method of claim 1, wherein the natural resource comprises a geothermal resource.

5. The method of claim 1, wherein the first material comprises a chemical and the interacting with the proppant material and the formation material comprises a chemical reaction.

6. The method of claim 1, wherein the material comprises a colloid.

7. The method of claim 1, wherein the material comprises a nanocomposite.

8. The method of claim 1, wherein an increase in the permeability of the reservoir caused by the circulating the first material through the reservoir results in a third fracture zone having about 90% a same permeability along a length of a wellbore that is from about 20 feet to about 200 feet.

9. The method of claim 1, wherein an increase in the permeability of the reservoir caused by the circulating the first material through the reservoir results in a third fracture zone having about 95% a same permeability along a length of a wellbore that is from about 20 feet to about 200 feet.

10. The method of claim 1, wherein an increase in the permeability of the reservoir caused by the circulating the first material through the reservoir results in a third fracture zone having more than 85% of the permeability being a same permeability along a length of a wellbore that is from about 20 feet to about 200 feet.

11. The method of claim 1, wherein an increase in the permeability of the reservoir caused by the circulating the first material through the reservoir results in a third fracture zone having about 90% a same permeability along a length of a wellbore that is from about 50 feet to about 500 feet.

12. The method of claim 1, wherein an increase in the permeability of the reservoir caused by the circulating the first material through the reservoir results in a third fracture zone having about 95% a same permeability along a length of a wellbore that is from about 50 feet to about 500 feet.

13. The method of claim 1, wherein an increase in the permeability of the reservoir caused by the circulating the first material through the reservoir results in a third fracture zone having more than 85% of the permeability being a same permeability along a length of a wellbore that is from about 50 feet to about 500 feet.

14. The method of claim 1, wherein an increase in the permeability of the reservoir caused by the circulating the first material through the reservoir results in a third fracture zone having about 90% a same permeability along a length of a wellbore that is from about 100 feet to about 500 feet.

15. The method of claim 1, wherein an increase in the permeability of the reservoir caused by the circulating the first material through the reservoir results in a third fracture zone having about 95% a same permeability along a length of a wellbore that is about 500 feet.

16. The method of claim 1, wherein the first material comprises a thermally-activated chemical solution that reacts with the proppant material and the formation material in fracture zones of reduced permeability to increase permeability of the fracture zones.

* * * * *